US008900684B2

(12) United States Patent
Bülow

(10) Patent No.: US 8,900,684 B2
(45) Date of Patent: Dec. 2, 2014

(54) VAPOUR BARRIER COLLAR

(75) Inventor: Anders Køhl Bülow, Gentofte (DK)

(73) Assignee: VKR Holding A/S (DK)

( * ) Notice: Subject to any disclaimer, the term of this patent is extended or adjusted under 35 U.S.C. 154(b) by 1222 days.

(21) Appl. No.: 12/659,417

(22) Filed: Mar. 9, 2010

(65) Prior Publication Data

US 2010/0257717 A1 Oct. 14, 2010

(30) Foreign Application Priority Data

Mar. 17, 2009 (DK) ..... 2009 00374

(51) Int. Cl.

| | |
|---|---|
| ***B32B 3/00*** | (2006.01) |
| ***E04D 15/00*** | (2006.01) |
| ***E04D 13/147*** | (2006.01) |
| ***B21J 15/14*** | (2006.01) |
| ***E04D 13/03*** | (2006.01) |

(52) U.S. Cl.

CPC ..... *E04D 13/031* (2013.01); *E04D 15/00* (2013.01); *E04D 13/1475* (2013.01); *B21J 15/14* (2013.01)

USPC ..... 428/58; 29/428; 29/592; 52/58; 52/60; 52/63; 52/64; 52/204.5; 52/214; 52/302.5; 52/302.6; 428/57; 428/105; 428/223; 156/263; 156/227; 156/196

(58) Field of Classification Search

USPC ..... 29/525.01; 52/58, 60, 63, 64, 204.5, 52/214, 302.5, 302.6; 428/58, 57, 105, 428/223; 156/263, 227, 196

See application file for complete search history.

(56) References Cited

U.S. PATENT DOCUMENTS

| | | | | |
|---|---|---|---|---|
| 4,341,007 | A | 7/1982 | Kruszona | |
| 7,874,121 | B1 * | 1/2011 | Hohmann, Jr. | 52/717.01 |
| 2005/0144856 | A1 | 7/2005 | Conlin | |
| 2008/0092463 | A1 * | 4/2008 | Poirier et al. | 52/204.5 |

FOREIGN PATENT DOCUMENTS

| | | |
|---|---|---|
| CA | 1153508 | 9/1983 |
| DE | 27 28 836 | 1/1979 |
| DE | 29 10 610 | 9/1980 |
| DE | 34 42 276 | 6/1985 |
| DE | 100 57 774 | 10/2002 |
| DE | 10057774 | 10/2002 |
| EP | 0 738 805 | 12/1999 |
| EP | 1010545 | 6/2000 |
| EP | 0994991 B1 | 10/2002 |

(Continued)

*Primary Examiner* — Peter DungBa Vo
*Assistant Examiner* — Azm Parvez
(74) *Attorney, Agent, or Firm* — Merek, Blackmon & Voorhees, LLC

(57) ABSTRACT

The invention relates to a vapour barrier collar (1) comprising a number of sheet elements (2, 3, 4, 5) including side sheet elements (2, 3), which extend substantially along a longitudinal axis (L), and top (4) and bottom (5) sheet elements, respectively, which extend substantially along a lateral axis (A), which is perpendicular to the longitudinal axis (L). Each sheet element (2, 3, 4, 5) has two end edges (6) adjacent to a first edge (7) of the sheet element (2, 3, 4, 5). The sheet elements (2, 3, 4, 5) are mutually joined together in joints (8) extending along the end edges (6), and mounting means (9) are provided along the first edges (7) of the sheet elements (2, 3, 4, 5). The mounting means (9) extend uninterruptedly along the entire length of the first edge (7) of each sheet element (2, 3, 4, 5).

3 Claims, 5 Drawing Sheets

(56) References Cited

FOREIGN PATENT DOCUMENTS

| | | |
|---|---|---|
| JP | 50137817 | 11/1975 |
| JP | 2003119971 | 4/2003 |
| RU | 2190737 | 10/2002 |
| WO | WO9606996 | 3/1996 |
| WO | WO0174540 | 11/2001 |

* cited by examiner

VAPOUR BARRIER COLLAR

CROSS-REFERENCE TO RELATED APPLICATIONS

The present application claims the priority under 35 U.S.C. 119 of Danish Application No. PA 2009 00347, filed Mar. 17, 2009, which is hereby incorporated herein by reference in its entirety.

BACKGROUND OF THE INVENTION

The present invention relates in a first aspect to a vapour barrier collar, in a second aspect to a method for producing such a vapour barrier collar, in a third aspect to a tool for use in mounting a vapour barrier collar and method for mounting a vapour barrier collar. A vapour barrier collar forms part of a vapour barrier assembly and provides a vapour-proof connection between for instance a window frame and an underroof.

A vapour barrier collar of the kind mentioned in the introduction to claim 1 is for instance known from the European patent EP 0 994 991. Such a vapour barrier collar is adapted to be mounted along the circumference of an aperture in a roof-penetrating building structure, such as an aperture of a window frame. The building structure may be any kind of roof-penetrating building structure, such as a roof window or a skylight.

The mounting takes place by inserting the mounting means of the vapour barrier collar in a circumferential groove surrounding the aperture. The mounting means are in the form of a number of individual "press-in pieces" of a relatively stiffer material compared to the vapour barrier collar material, the press-in pieces being distributed with intervals along the edge of the collar that is to be inserted into the groove of the building structure. However, to ensure a reliable and sealing mounting of the vapour barrier collar in the groove, use of additional mounting means is necessary. For this purpose, i.a. strips of butyl rubber is inserted in the groove of the building structure prior to inserting the press-in pieces of the vapour barrier collar. In order to ensure a sufficient degree of sealing against heat loss, condensation and vapour, great care must be taken when inserting the strips of butyl rubber. As it is time consuming and difficult to place the butyl strip correctly it is hard to obtain a sufficient degree of sealing.

Furthermore, often the butyl rubber strips simply let go of the groove e.g. due to dust, wet spots etc. For this reason, screws are used to secure the mounting means in the groove on top of the butyl rubber strips. Thus, the amount of time required to mount a vapour barrier collar is relatively extensive.

In the case of for instance a roof window, the lining, which is inserted in the groove subsequently to the mounting of the vapour barrier collar, assists in providing the sealing effect by squeezing the butyl rubber strips and mounting means to abut the walls of the groove closely. For this reason, the lining must be mounted with great care too. Often, the lining, which is used, is of a different brand than the vapour barrier collar and/or the groove and may thus not fit perfectly. This increases the risk of an unsatisfactory sealing.

SUMMARY OF THE INVENTION

On this background it is an object of the present invention to provide a vapour barrier collar of the kind mentioned in the introduction, which avoids or mitigates at least some of the disadvantages of the prior art.

These and other objects are met by providing in a first aspect of the invention a vapour barrier collar of the kind mentioned in the introduction, the mounting means of said vapour barrier collar extending uninterruptedly along the entire length of said first edge of each sheet element.

The provision of uninterrupted mounting means has the advantage that a stronger and more reliable fastening and mounting of the vapour barrier collar is obtained as the mounting means cover the entire rim formed by the first edges of all the sheet elements. Also, the mounting means can thus provide an isolating effect without additional fastening or isolation means being necessary. Furthermore, the mounting process of the vapour barrier collar is facilitated. All of these advantages will be explained in further detail below.

In one embodiment, the mounting means of the vapour barrier collar are formed by a strip element attached to each sheet element. This is an inexpensive and simple solution.

Alternatively, the mounting means are an integrated part of each sheet element formed by a folded or rolled up part of each sheet element. This is advantageous, as provision of separate strips is thus not necessary. The material for producing the mounting means is always at hand in the form of sheet element material.

The mounting means of the vapour barrier collar are adapted to be received in a circumferential groove of a building structure, said mounting means preferably abutting in a mounted position sidewalls of said groove providing a sealing effect against said sidewalls of the groove.

This has more benefits. Firstly, the mounting means are able to stay in the groove solely by their interaction with the sidewalls of the groove. This provides for the vapour barrier collar to be self-supporting in the sense that it is able to stay in the groove without additional mounting or fastening means. Thus screws and the like may be rendered superfluous, resulting in a reduced amount of time required for mounting the vapour barrier collar. Advantageously, this also eliminates the risk of damaging or piercing the sheet elements with the screws at undesirable places. Alternatively, however, means may be provided for indicating the position of additional mounting screws. Secondly, the sealing effect of the mounting means makes the use of butyl rubber strips superfluous, which butyl rubber strips may therefore be omitted. All in all, the mounting of a vapour barrier collar according to the present invention is eased considerably compared to the mounting of a conventional vapour barrier collar.

In one embodiment of the mounting means in the form of a strip element, the strip element comprises more than one component, i.e. it is composed of more than one material. Preferably, it comprises two components, each of which extends in a direction along the longitudinal axis of the strip element, the second component being located primarily in zones, which in a mounted position of the strip element abut the side walls of the groove, and the first component being located primarily in a zone extending between the zones of the second component.

This structure of the strip element is particularly advantageous, when the second component is of a more flexible material than the first component, as a better sealing effect against the sidewalls of the groove is thus obtained.

Further zones of second component may be provided, for instance in a zone of the strip element, which zone may abut the bottom wall of the groove in a mounted position of the strip element.

In one embodiment, the vapour barrier collar is provided with a reinforcement element at each joint, said reinforcement element covering part of said joint and part of said joined sheet elements in an area adjacent to the joint and extending from the first edges of said joined sheet elements. This increases the robustness of the vapour barrier collar.

A tool is provided for use in mounting a vapour barrier collar of the above-mentioned kind. The tool comprises insertion means for introducing mounting means of the vapour barrier collar into a groove adapted to receive said mounting means, and operating means for operating the tool, where the insertion means comprise a face for applying a pressure on the mounting means and are connected to the operating means in at least one point. This "at least one point of contact" is understood also to comprise multiple points of contact in close vicinity of each other, i.e. a zone or region of contact.

In order to obtain a smooth movement of the tool and a proper and precise mounting of the mounting means of the vapour barrier collar, the width of the face of the insertion means is slightly smaller than the distance between the two sidewalls of the groove.

Preferably, the face of the insertion means is convexly curved around an axis running parallel to the width of the face. This structure of the tool renders it possible to force the mounting means into the groove with a sliding movement of the tool upon the mounting means thus easing the mounting process even further and reducing the time required for the mounting. The convex curving of the face allows the operator to use the tool in an angle comfortable to him or her under the prevailing conditions.

In one embodiment, the operating means of the tool comprise an oblong cavity and an opening towards the ambient in connection with the cavity, which is able to receive at least partially and retain an object, such as a carpenter's pencil. "Oblong" means that the dimension of the cavity in a longitudinal direction is at least slightly larger than the dimension of the cavity in a transversal direction. In this way, the object, for instance a carpenter's pencil, serves as a handle as it prolongs the operating means of the tool when partly contained in the cavity. This provides for a tool that is always at hand. As the tool can be removed from the carpenter's pencil when not in use the tool is very little space consuming due to its compact structure.

In one embodiment of the tool, the operating means are oblong so as to serve as a handle. Again, "oblong" means that the dimension of the operating means in a longitudinal direction is at least slightly larger than the dimension of the operating means in a transversal direction. Preferably, the dimension of the operating means in the longitudinal direction is of a size permitting the operating means to be used as handle. This configuration makes it possible to operate the tool independently of the presence of for instance a carpenter's pencil.

In one embodiment, the insertion means approach and/or abut the operating means in a distance from the connection point between the insertion means and the operating means thus forming a pen clip-like structure. This way multiple functionalities are provided in a very compact manner: An ability to park the tool and any e.g. pencil or pen partly received in it by the pen clip-like structure is obtained, while the face of the pen clip-like structure serves as insertion means when in use for mounting. Furthermore, great robustness of the insertion means is obtained as the operating means serve as support for the end of the insertion means being in a distance from the connection point.

In a second aspect of the present invention, a method for producing a vapour barrier collar is provided, the method comprises the steps of:

cutting out a number of sheet elements, including side sheet elements extending in an assembled condition substantially along a longitudinal axis and top and bottom sheet elements, respectively, extending in an assembled condition substantially along a lateral axis perpendicular to said longitudinal axis, each sheet element having two end edges adjacent to a first edge of said sheet element, providing mounting means along said first edge of each sheet element, joining together said sheet elements in joints extending along said end edges, where the mounting means are provided extending uninterruptedly along the entire length of said first edge of each sheet element.

The sheet elements are joined by for instance welding, gluing, heat sealing or any other suitable process.

In one embodiment the sheet elements are all trapezoidal. Preferably, the angle between the first edge and each end edge, respectively, of a sheet element is the same for all sheet elements, thus forming, when joined together, a vapour barrier collar having the shape of a frustum of a pyramid.

This configuration ensures, that the vapour barrier collar is useful with many different roof pitches and is also advantageous in relation to the joining process of the sheet elements as will be discussed in more detail below.

The provision of the mounting means may take place prior to or subsequent to the joining of the sheet elements. The mounting means may comprise an individual section per sheet element, the individual sections of the mounting means being joined at the joints of the sheet elements. This may particularly be expedient, when the mounting means are provided to the sheet elements prior to the joining of the sheet elements. Alternatively, the mounting means may extend uninterruptedly along the entire circumference formed by the first edges of the sheet elements. This may particularly be expedient, when the mounting means are provided to the sheet elements subsequently to the joining of the sheet elements.

In one embodiment, the method comprises, prior to the step of joining together said sheet elements, the step of precise mutual positioning of said sheet elements and possibly reinforcement elements by means of guide holes provided in the sheet elements and/or mounting means. The guide holes interact with guide pins provided in a tool. This enables production of very accurately dimensioned vapour barrier collars, the dimensions of which lie within relatively small tolerances.

In the case of joining together sheet elements of identical trapezoidal shape, the above-described step of positioning the sheet elements precisely in relation to each other requires less space compared to the space required when positioning sheet elements of the kind forming a vapour barrier collar as described in EP 0 994 991. This is due to the fact that the identically trapezoidal-shaped elements inherently coincide when put on top of each other.

In one embodiment, the method furthermore comprises the step of packing the vapour barrier collar by rolling it up around the lateral axis in a direction along the longitudinal axis so that the packed vapour barrier collar substantially forms a roll. This provides for easier mounting, as the roll can be unrolled bit by bit, as the mounting of the vapour barrier collar around the aperture of the building structure progresses. Also, the correct orientation of the vapour barrier collar in relation to the building structure is more easily recognized by the user, possibly in combination with a clear marking of the orientation on the vapour barrier collar. For instance, the vapour barrier collar may be rolled up in such a way that the top sheet element makes the outer layer of the roll, so that the user easily can initiate the mounting of the vapour barrier collar from the top of the building structure. Packing the vapour barrier collar in conventional cardboard boxes is also possible, as the mounting means are sufficiently flexible for being folded with the remaining of the vapour barrier collar so as to fit in a box.

BRIEF DESCRIPTION OF THE DRAWINGS

Further embodiments and advantages will appear from the following, where some exemplary embodiments of the present invention will be described in further detail, some with reference to the accompanying schematic drawings, where.

DETAILED DESCRIPTION OF THE PREFERRED EMBODIMENTS

Figure 1:
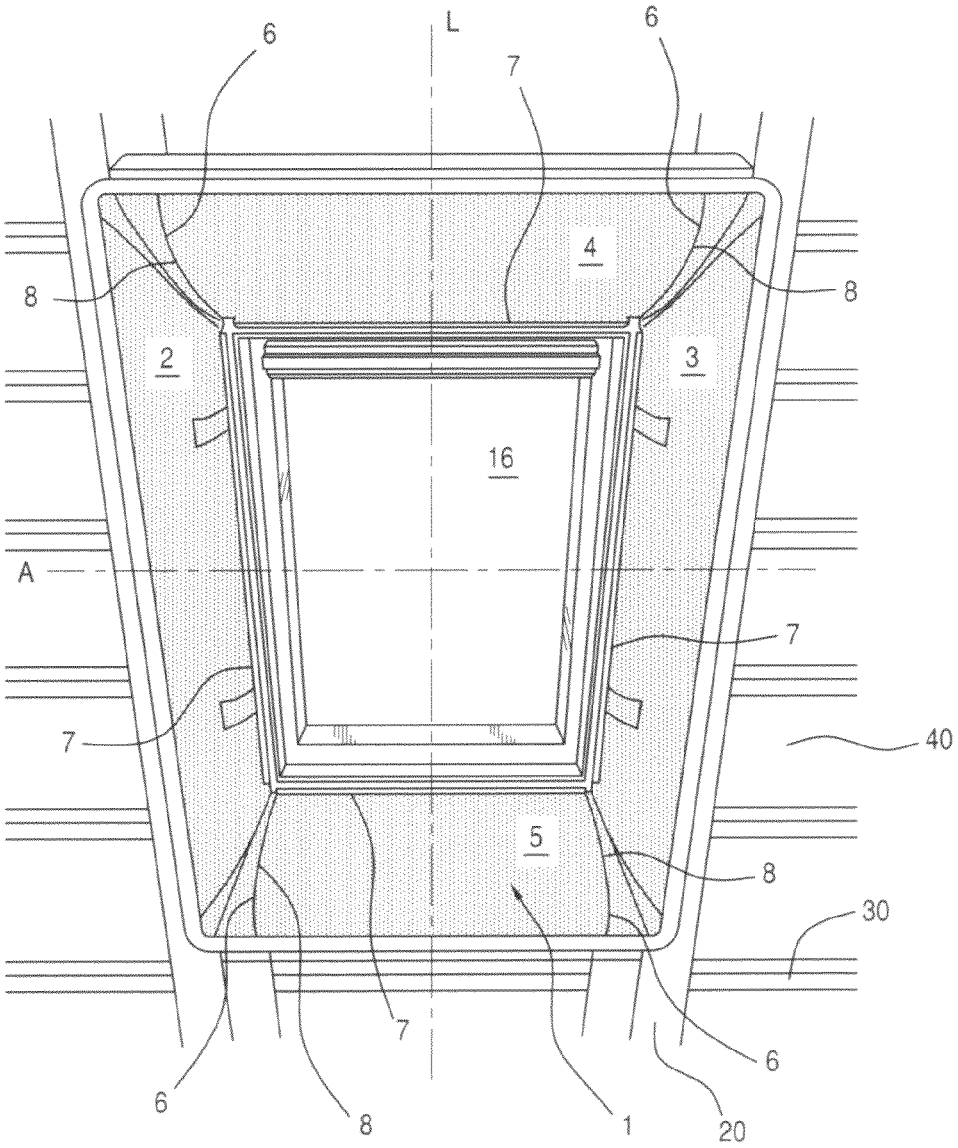
FIG. 1 is a front view of a vapour barrier collar according to the present invention in a mounted condition, surrounding an aperture of a roof-penetrating building structure.

FIG. 1 is a schematic front view of a vapour barrier collar generally designated 1 in an embodiment of the present invention. The vapour barrier collar 1 comprises a number of sheet elements 2, 3, 4, 5. In this particular embodiment two side sheet elements 2, 3 a top sheet element 4 and a bottom sheet element 5 are provided. The side sheet elements 2, 3 extend in a direction along a longitudinal central axis L, and the top and bottom sheet elements, respectively, extend in a direction along a lateral central axis A perpendicular to the longitudinal axis L. The roof-penetrating building structure is in the following referred to as window 16*a*, and the aperture of the window 16 is referred to as aperture 16.

The vapour barrier collar 1 is intended to be connected to a vapour barrier membrane 40 of an underroof forming part of an overall roof structure. The underroof is arranged essentially between rafters 20 and with an inner cladding (not shown) in the form of a board layer or panels fastened to the inner side of the rafters 20, the vapour barrier membrane 40, which may be produced by plastic foil, aluminium foil, kraft paper or laminates hereof, an isolation layer (not shown), the outside of which is arranged at a distance below the outside of the rafters 20 in order to provide ventilation, and an outer cladding (not shown), on the outside of which a (not shown) weather-shielding outer membrane is positioned and to which is fastened an arrangement of counter battens and battens 30 as a support for a (not shown) outer roofing, which can consist of tiles or slates. In this manner a vapour-proof transition between the roof window 16*a* and the vapour barrier membrane 40 of the underroof is obtained.

The vapour barrier collar 1 is, in the embodiment shown, substantially symmetrical about both the longitudinal central axis L and the lateral central axis A. Due to this symmetry, it is understood that the description applies for all sections of the vapour barrier collar 1 though only one section of the vapour barrier collar 1 is described.

In one embodiment the vapour barrier collar is composed of four trapezoidal sheet elements 2, 3, 4, 5 welded together to form a vapour barrier collar having the shape of a frustum of a pyramid. It is to be understood that the invention described is equally applicable to a vapour barrier collar having the shape shown in the above-mentioned EP 0 994 991.

Each sheet element 2, 3, 4, 5 has two end edges 6 adjacent to a first edge 7. Adjacent sheet elements are mutually joined together in joints 8 extending along the end edges 6. In this manner, the vapour barrier collar forms a collar including a coherent rim along the first edges of the respective sheet elements.

In one embodiment, the sheet elements 2, 3, 4, 5 are identically trapezoidal-shaped, i.e. the angle between the first edge 7 and each end edge 6, respectively, of a sheet element 2, 3, 4, 5 is the same for all sheet elements, thus forming, when joined together, a vapour barrier collar having the shape of a frustum of a pyramid. This configuration provides for use of the vapour barrier collar 1 with many different roof pitches. The angle between the first edge 7 and each respective end edge 6 lies in the interval between 90° and 180°, however preferably between 95° and 175°, and more preferably between 110° and 130°. The vapour barrier collar 1 is thus applicable in connection with roof pitches lying in the interval between 5° and 85°, however preferably between 15° and 60°.

Figure 2:
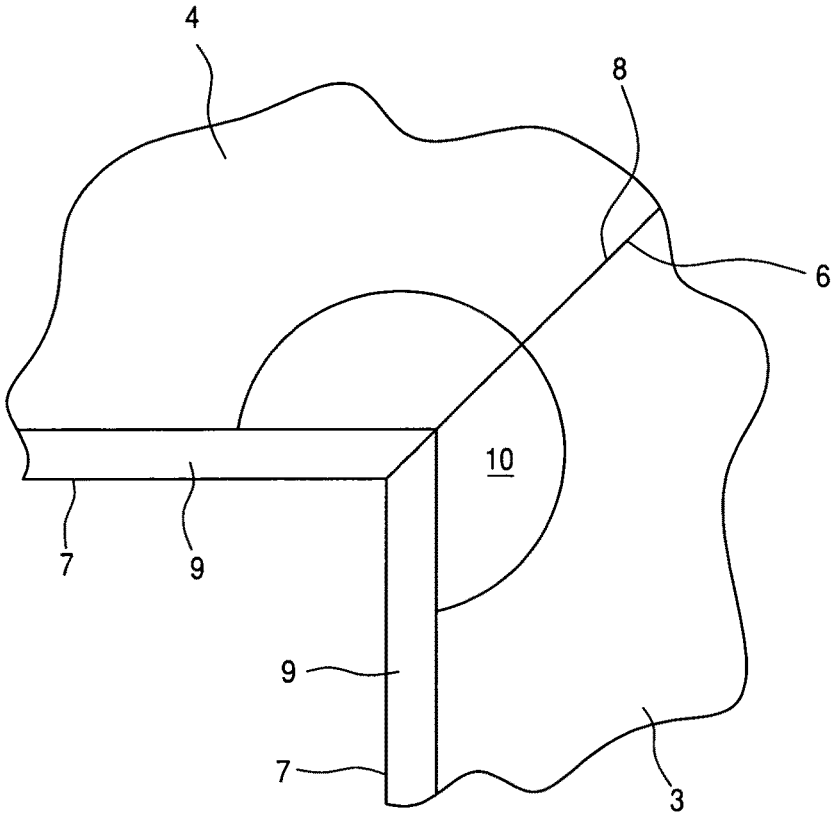
FIG. 2 shows a section of a vapour barrier collar according to the present invention, more specifically an area adjacent a joint.

In the embodiment shown, as is best seen on FIG. 2, the orientation of the projection of the joint 8's direction on the mounting means plane is 45 degrees in relation to the production of the first edge 7 of the sheet element 3 extending in the longitudinal direction L. Similarly, although not interpretable from FIG. 2, the orientation of the projection of the joint 8's direction on the plane extending in the longitudinal direction L of the vapour barrier 1 perpendicular to the mounting means plane is 30 degrees in relation to the production of the first edge 7 of the sheet element 3 extending in the longitudinal direction L. However, different angles may apply to different applications, one example being described in further detail below.

The end edges 6 and the first edge 7 of two sheet elements 3, 4 joined together in a joint 8 is seen in FIG. 2 in detail. FIG. 2 also shows the mounting means 9, which are provided along the first edges 7 of the sheet elements 3, 4. A reinforcement element 10 is provided at the joint 8. The reinforcement element 10 covers part of the joint 8 and part of joined sheet elements 3, 4 in an area adjacent to the joint 8 and extending from the first edges 7 of the joined sheet elements 3, 4. Even though the area in the shown embodiment is circular, other shapes of the area could be envisaged.

Prior to joining of neighbouring sheet elements 2, 3, 4, 5 they are positioned precisely in relation to each other by means of guide holes (not shown) provided in the sheet elements 2, 3, 4, 5 and preferably going through the mounting means 9 as well in cooperation with guide pins provided in the apparatus for joining the sheets 2, 3, 4, 5. Thus, when two sheet elements are to be joined they are placed in the apparatus for joining the sheets with the guide pins of the apparatus projecting through the guide holes in the sheet elements and mounting means. This way the vapour barrier collar is joined very accurately.

When joining together sheet elements 2, 3, 4, 5 of identical trapezoidal shape, little space is needed for positioning the sheet elements 2, 3, 4, 5 precisely in relation to each other compared to the space needed when positioning sheet elements of different shape as for instance trapezoidal side sheet elements and rectangular top an bottom sheet elements, as the identically shaped sheet elements 2, 3, 4, 5 are coincident when put on top of each other.

As regards the mounting means, they are, in the embodiment depicted in FIG. 2, formed by a strip element 9 attached to each sheet element prior to the joining of the sheet elements. Each strip 9 is extending uninterruptedly along the entire length of the first edge 7 of each sheet element and adjacent strips 9 are joined in the joints 8 along with their respective sheet elements. In this manner, the collar-shaped vapour barrier collar has uninterrupted mounting means along its entire rim along the first edges of the sheet elements.

Figure 3A:
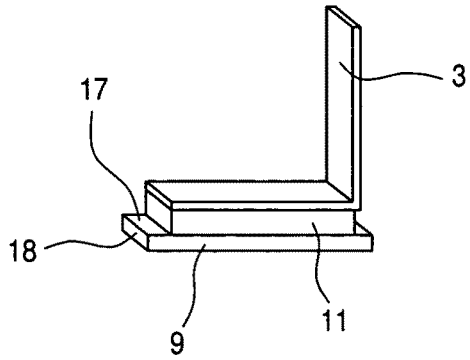
FIG. 3*a* shows another section of a vapour barrier collar according to the present invention, including mounting means.
Figure 3B:
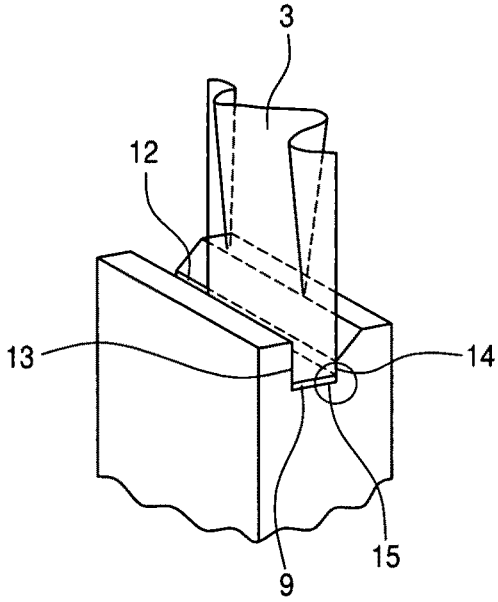
FIG. 3*b* shows the section of FIG. 3*a* in a mounted position.
Figure 3C:
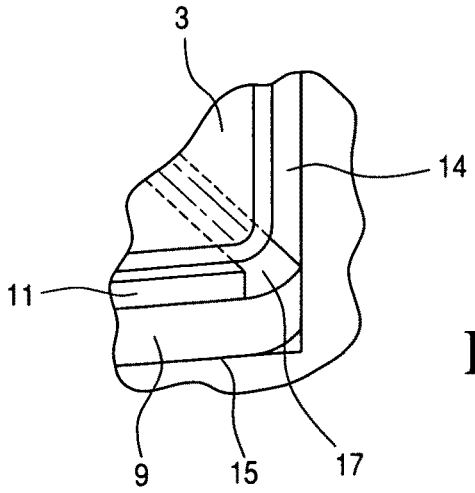
FIG. 3*c* is a detail of FIG. 3*b* on a larger scale.

Referring now to FIGS. 3*a-c*, the mounting means 9 will be described in further detail. FIG. 3*a* shows a section of an embodiment of the vapour barrier collar 1 including a sheet element 3 and mounting means in the form of a strip element 9 attached thereto. The strip element 9 is extruded from a plastics material, such as polyethylene. The strip 9 has two opposite faces 17 extending between two relatively short end faces 18. The sheet element 3 is attached to the strip 9 at one of the faces 17 by welding, gluing, heat sealing or any other suitable process. On FIG. 3*a*, a welding seam 11 is indicated. The strip 9 may be attached to the sheet element 3 along a central part of the strip 9, leaving the parts adjacent to the central part unattached as illustrated in FIG. 3*a*. This may yield a more flexible strip. Alternatively, the strip may be attached to the sheet element over its entire surface.

FIG. 3*b* shows the section of the embodiment of the vapour barrier collar 1 from FIG. 3*a*, now mounted in a groove 12. The groove 12 represents a groove such as the one surrounding an aperture of a building structure, for instance the groove (not clearly discernible) surrounding the roof window aperture 16 in FIG. 1. The groove 12 has two sidewalls 13, 14 extending substantially perpendicular to a bottom wall 15. The strip 9 is inserted into the groove 12 so that the face 17 of the strip 9, opposite the face 17 attached to a sheet element 3, abuts the bottom wall 15 of the groove 12. Also, the two short end faces 18 of the strip 9 abut each their sidewall 13, 14 of the groove 12. 18. In principle, the mounting means of the vapour barrier collar may be brought to abut at least one side face of the circumferential groove, or at least one side face and the bottom face of the circumferential groove.

As is best seen from FIG. 3*c*, the strip 9 is somewhat over-dimensioned in relation to the width of the groove 12 so that the strip 9 is slightly deformed when inserted into the groove 12. Thereby a good sealing effect is obtained, and also a good securing of the strip 9 and thus of the entire vapour barrier collar 1 in the groove 12.

The strip 9 may be substantially plane as shown. The thickness of the strip 9 is preferably in the range of approximately 0.5-5 mm, more preferably in the range of approximately 1-3 mm, and most preferably approximately 2 mm. Alternatively, the strip may vary in thickness from one end face 18 to the other. For instance, the strip may have a larger thickness proximal to the end faces in proportion to the thickness of the central part of the strip, or vice versa, the thickness of the central part of the strip may be larger in proportion to the thickness proximal to the end faces, which in this latter case ultimately may be reduced to lines.

Figure 4A:
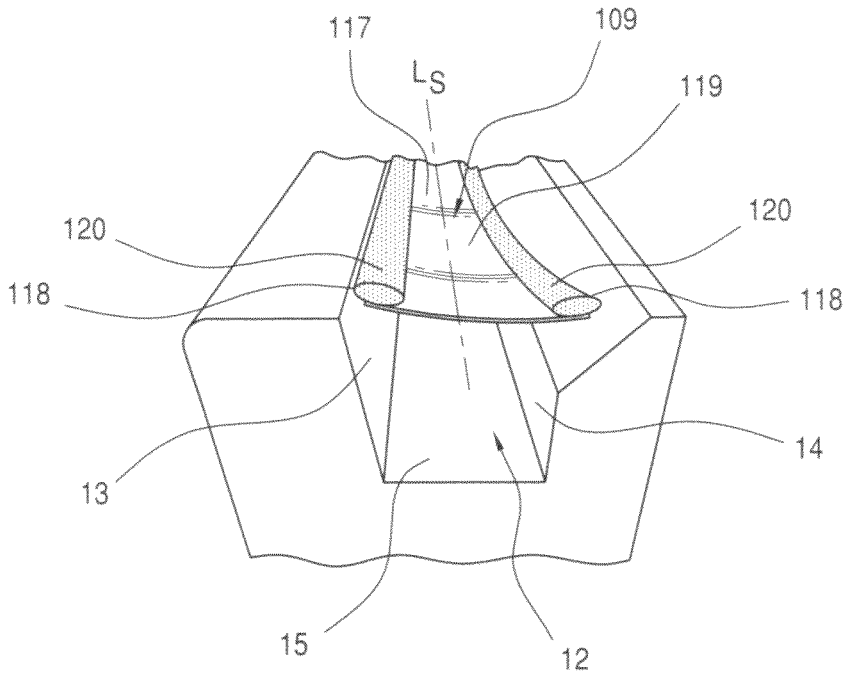
FIG. 4*a* shows a section of an embodiment of mounting means for a vapour barrier collar according to the present invention in a partially mounted condition.
Figure 4B:
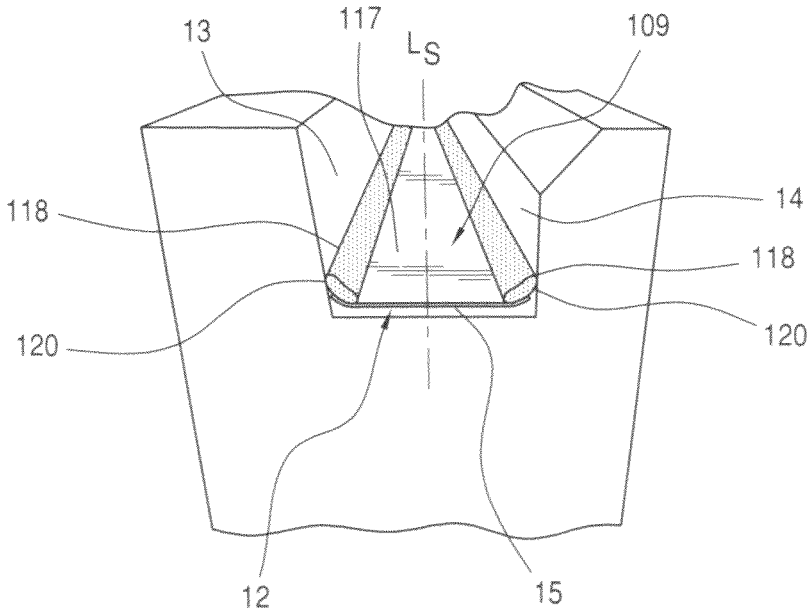
FIG. 4*b* shows the section of the embodiment of the mounting means of FIG. 4*a* in a fully mounted position.

In one embodiment of the strip element, it comprises more than one component. FIGS. 4*a-b* show an embodiment of a strip 109 comprising a first component 119 and a second component 120. The strip 109 has the same overall structure as described above, i.e. with two opposite faces 117 extending between two relatively short end faces 118, all of which extend in a direction along a longitudinal axis LS of the strip 109. Also, the same considerations as above regarding thickness and possible variation of thickness from one end face 118 to the other apply. A sheet element (not shown) is to be attached to the strip 109 at the face 117 facing away from the groove 12 in a manner and to an extent as described above.

Each of the components 119, 120 extends in a direction along the longitudinal axis LS of the strip 109, the second component 120 being located primarily in zones proximal to the two end faces 118, while the first component 119 is primarily located in a zone extending between the zones of the second component 120.

Considering the cross sectional area of the strip 109 perpendicular to its longitudinal axis LS, the zones of the second component 120 preferably constitute 5-60% of the cross sectional area, more preferably 10-40% and most preferably 20-30%.

The first component 119 is preferably extruded from a plastics material, such as polyethylene. The second component 120 is preferably made of a more flexible material in comparison with the material of the first component 119, such as for instance Santoprene®. Thus, the relatively stiff first component 119 provides stiffness and stability to the strip 109, while the relatively flexible second component yields good sealing capability and also a good securing of the strip 109 in the groove 12. This may best be seen from FIG. 4*b* showing the strip element 109 in a fully mounted position with the zones of the second component 120 abutting the sidewalls 13, 14 of the groove 12.

Of course, other structures of the strip 109 may be envisaged, for instance, a strip with one or more additional zones of second component 120 running along the central part of the strip intended to face the bottom wall 15 of the groove 12, thus providing an extra sealing effect. In a further, not-shown, embodiment the mounting means are an integrated part of each sheet element formed by a folded or rolled up part of each sheet element. The folded or rolled up part of the sheet element may be fixed in its folded or rolled up condition by any suitable process such as for instance welding, gluing or heat sealing. The observations stated above in relation to the strip-type mounting means also apply to this integrated, folded or rolled up-type mounting means as regards dimensions, cross sectional shape, attachment etc.

It is understood that the invention is not limited to the embodiments described and/or shown in the above, but various modifications and combinations may be carried out without departing from the scope of the claims.

For instance, although the joined side, top and bottom sheet elements in the embodiment shown and described in the above form a vapour barrier collar fitting a rectangular aperture of a roof-penetrating building structure, other geometrical configurations are conceivable. For instance, there may be provided any number of sheet elements and/or sheet elements of alternative shapes to be joined to form a vapour barrier collar of a shape other than rectangular. For instance, a vapour barrier collar fitting a semicircular window aperture could be envisaged. Also, the vapour barrier collar may be applied for surrounding different types of apertures of roof-penetrating building structures, such as roof windows, windows, doors, escape ways, ventilation ducts etc.

Figure 5A:
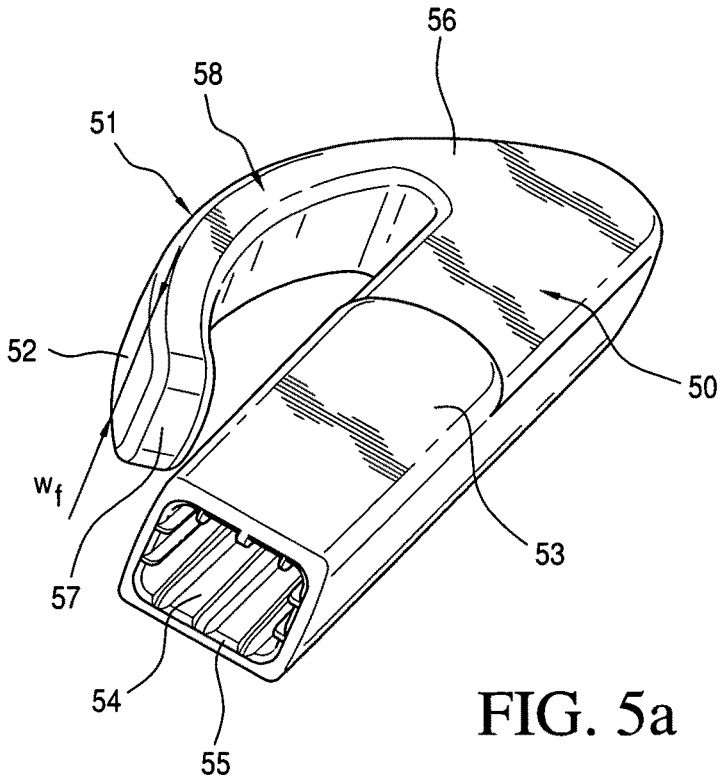
FIG. 5*a* is a perspective view of an embodiment of a tool for use in mounting a vapour barrier according to the present invention.
Figure 5B:
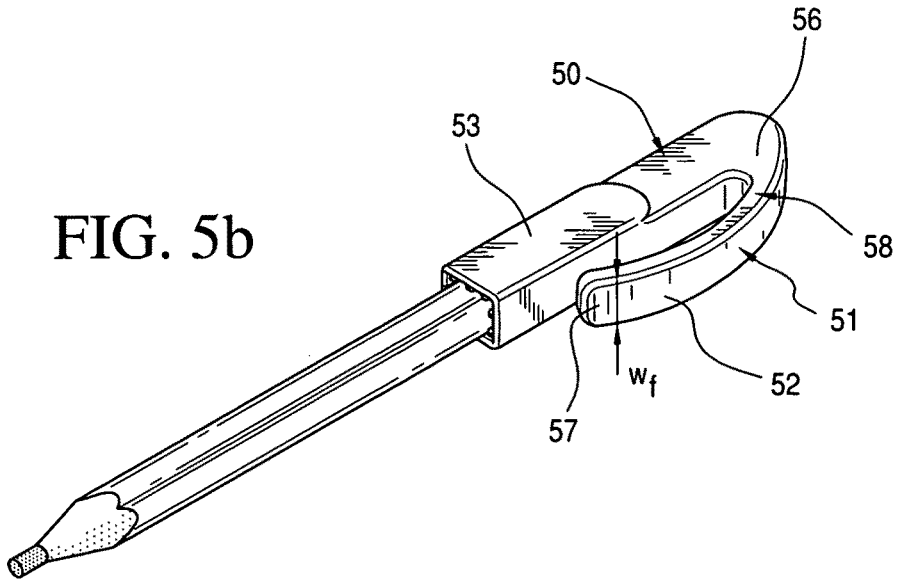
FIG. 5*b* is a perspective view of the embodiment of the tool of FIG. 5*b* seen from a different angle and with a carpenter's pencil inserted.

Now referring to the FIGS. 5*a-b*, a tool for use in mounting a vapour barrier collar will be described in further detail. The tool is applicable for use in mounting a vapour barrier collar whether formed by 1) four trapezoidal sheet elements, 2) two trapezoidal sheet elements and two rectangular sheet elements as the prior art vapour barrier collar described in EP 0

994 991, or 3) any other shape as described in the foregoing paragraph. In the embodiment shown, the tool 50 comprises insertion means 51 for introducing mounting means of the vapour barrier collar into a groove adapted to receive said mounting means, and operating means 53 for operating the tool 50. The insertion means 51 comprise a face 52 for applying a pressure on the mounting means and are connected to the operating means 53 in a region of contact at a first end 56 of the insertion means 51.

The face 52 of the insertion means 51 is convexly curved around an axis running parallel to the width wf of the face 52. The radius of curvature is constant and approximately amounts 150 mm. The radius of curvature may be constant or vary and preferably lies in the area between 50-300 mm, more preferably between 100-200 mm. Alternatively, a completely flat face may be envisaged.

As regards the width wf of the face 52, it is expedient that it is slightly smaller than the distance between the two sidewalls of the groove into which the mounting means of the vapour barrier collar is to be inserted. In the shown embodiment, the width wf is approximately 8 mm. The width wf generally preferably lies between 3-15 mm.

The operating means 53 of the shown embodiment of the tool 50 comprise an oblong cavity 54 and an opening 55 towards the ambient in connection with the cavity 54. The cavity 54 is able to receive at least partially and retain a correspondingly oblong object, such as a carpenter's pencil (as shown in FIG. 5*b*). As explained above, by "oblong" is understood that the dimension of the cavity 54 in a longitudinal direction is at least slightly larger than the dimension of the cavity 54 in a transversal direction. In this particular embodiment, the dimension of the cavity 54 in a longitudinal direction is approximately 1.5 times larger than the dimension of the cavity 54 in a transversal direction. This is a preferred dimensioning of the cavity as a carpenter's pencil will most often into a cavity of this size thus serving as a handle as it prolongs the operating means of the tool 50. Different cross sectional shapes may be envisaged besides rectangular, for instance square, oval, elliptic or round.

In the case where the operating means of the tool are oblong so as to serve as a handle them selves, the same considerations as above regarding "oblong" apply. However, the dimension of the operating means in the longitudinal direction must in this case be of a size permitting the operating means to be used as handle, i.e. the operating means preferably have a dimension in the longitudinal direction of 15 mm. Preferably, the dimension of the operating means in the longitudinal direction in this embodiment lies between 10-20 mm. In the depicted embodiment, the insertion means 51 approaches the operating means 53 in a distance from the connection point between the insertion means 51 and the operating means 53 thus forming a pen clip-like structure 58. The distance preferably lies in the range of 3-7 mm. The insertion means 51 may abut the operating means 53.

It the following, it will be explained how the tool 50 is utilized in mounting the vapour barrier collar 1 in a roof-penetrating building structure. The mounting means 9 of the vapour barrier collar 1 is successively introduced into the circumferential groove 12 of a building structure by applying a pressure on the mounting means 9 by the aid of the tool 50 while carrying out a sliding movement of said tool 50 upon the mounting means 9 in a direction parallel to the first edge 7 of each sheet element 2, 3, 4, 5. The face 52 of the insertion means 51 of the tool 50 faces the mounting means 9 of the vapour barrier collar 1. Since the mounting means 9, as explained above, are somewhat over-dimensioned in relation to the width of the groove 12, the mounting means 9 are successively secured well in the groove 12 and stays there while the tool is slid further on upon the mounting means.

Optionally, the above mentioned guide holes preferably going through both sheet elements 2, 3, 4, 5 and mounting means 9 may serve an additional purpose in relation to mounting the vapour barrier collar 1 in a groove. The guide holes are namely of a size to permit the body of a typical size screw for this purpose to pass through the guide hole, while the head of the screw will be retained by the guide hole. Preferably, the guide hole intended to receive a mounting screw may be marked in any suitable manner, for instance by a colour marking, a different size or the like. This way, even though not necessary, screws may be utilized for securing the mounting of the vapour barrier to an extra degree by aid of screws.

The invention is not delimited to the embodiments described in the above and shown in the drawings but various modifications and combinations may be carried out without departing from the scope of the claims.

The invention claimed is:

1. Vapour barrier collar comprising a number of sheet elements including side sheet elements extending substantially along a longitudinal axis and top and bottom sheet elements, respectively, extending substantially along a lateral axis perpendicular to said longitudinal axis, each sheet element having two end edges adjacent to a first edge of said sheet element, said sheet elements being mutually joined together in joints extending along said end edges so that said end edges when joined form a vapour barrier collar having the shape of a frustrum of a pyramid, and mounting means are provided along said first edges of said sheet elements, characterized in that said first edge of each sheet element defines an entire length, said mounting means extend uninterruptedly along the entire length of said first edge of each sheet element, wherein said mounting means is formed by a strip element attached to each sheet element, and wherein the sheet elements is attached to the strip element at one of its faces by welding, gluing or heat sealing; and wherein said strip element comprises a first component and a second component, each of said components extending along a longitudinal axis of said strip, said second component being located primarily in zones proximal to two end faces of said strip, said end faces extending substantially parallel to the longitudinal axis of the strip, and said first component being primarily located in a zone extending between said zones of said second component.

2. Vapour barrier collar according to claim 1, wherein said mounting means are adapted to be received in a circumferential groove surrounding an aperture of a building structure, said mounting means abutting in a mounted position sidewalls of said groove providing a sealing effect against said sidewalls of the groove.

3. Vapour barrier collar according to claim 1, wherein said vapour barrier collar is provided with a reinforcement element at each joint, said reinforcement element covering part of said joint and part of said joined sheet elements in an area adjacent to the joint and extending from the first edges of said joined sheet elements.

* * * * *